US011231249B2

(12) United States Patent
Clum et al.

(10) Patent No.: US 11,231,249 B2
(45) **Date of Patent: *Jan. 25, 2022**

(54) PRESSURE ACTIVATED RELEASE CUE FOR ARCHERY

(71) Applicant: Rocky Mountain Specialty Gear, Inc., Wheat Ridge, CO (US)

(72) Inventors: Thomas Frank Clum, Arvada, CO (US); Alexander Marlon Droessler, Lakewood, CO (US); Robert Gould, Elizabeth, CO (US)

(73) Assignee: ROCKY MOUNTAIN SPECIALTY GEAR, INC., Wheat Ridge, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/909,681

(22) Filed: Jun. 23, 2020

(65) Prior Publication Data

US 2021/0071985 A1 Mar. 11, 2021

Related U.S. Application Data

(63) Continuation of application No. 16/562,028, filed on Sep. 5, 2019, now Pat. No. 10,712,119.

(51) Int. Cl.

| | |
|---|---|
| ***F41B 5/00*** | (2006.01) |
| ***F41B 5/14*** | (2006.01) |
| ***A41D 19/00*** | (2006.01) |

(52) U.S. Cl.

CPC ..... *F41B 5/1434* (2013.01); *F41B 5/14* (2013.01); *A41D 19/0031* (2013.01)

(58) Field of Classification Search

CPC ..... F41B 5/1434; F41B 5/14; A41D 19/0031; A63B 69/00; A63B 69/36

See application file for complete search history.

(56) References Cited

U.S. PATENT DOCUMENTS

| | | | | |
|---|---|---|---|---|
| 1,303,876 | A | 5/1919 | Francis | |
| 1,336,066 | A | 4/1920 | Briggs et al. | |
| 1,674,868 | A | 6/1928 | Lee | |
| 1,699,645 | A | 1/1929 | Williams et al. | |
| 3,097,624 | A | 7/1963 | Bergquist | |
| 3,443,558 | A | 5/1969 | Peck | |
| 3,463,117 | A | 8/1969 | Killian | |
| 3,499,414 | A * | 3/1970 | Frydenlund | F41B 5/143 116/67 R |
| 3,518,959 | A | 7/1970 | Bunker | |
| 3,669,059 | A | 6/1972 | Stuart | |
| 3,866,592 | A | 2/1975 | Carella | |

(Continued)

OTHER PUBLICATIONS

Official Action for U.S. Appl. No. 16/562,028, dated Dec. 11, 2019, 6 pages.

(Continued)

*Primary Examiner* — John E Simms, Jr.

(74) *Attorney, Agent, or Firm* — Sheridan Ross P.C.

(57) ABSTRACT

An interactive device for improving accuracy in archery and similar endeavors is provided. In some embodiments, a deformable device is provided that is operable to communicate with an archery bow and receive force during use of the bow. The deformable device is operable to deflect in a manner that produces an audible and tactile signal to a user. The signal may correspond to an appropriate amount of string tension or draw, for example.

20 Claims, 11 Drawing Sheets

(56) References Cited

U.S. PATENT DOCUMENTS

| | | | | |
|---|---|---|---|---|
| 4,061,107 | A | 12/1977 | Smith | |
| 4,368,719 | A | 1/1983 | Christopher | |
| 5,435,068 | A | 7/1995 | Thames et al. | |
| 5,435,292 | A | 7/1995 | Armstronng | |
| 5,652,955 | A | 8/1997 | Skewis | |
| 9,756,885 | B1 * | 9/2017 | Williams | A41D 1/002 |
| 9,970,730 | B2 | 5/2018 | Thacker, Jr. | |
| 10,345,169 | B2 | 7/2019 | Dunham et al. | |
| 10,712,119 | B1 * | 7/2020 | Clum | F41B 5/14 |
| 2002/0129437 | A1 * | 9/2002 | Erker | A41D 19/01547 2/161.2 |
| 2008/0189827 | A1 * | 8/2008 | Bauer | A61B 5/225 2/161.2 |
| 2009/0077712 | A1 * | 3/2009 | Polucha | A63H 5/00 2/160 |
| 2011/0212790 | A1 * | 9/2011 | Webb | A63B 69/38 473/202 |
| 2014/0215684 | A1 * | 8/2014 | Hardy | A41D 19/0031 2/160 |
| 2018/0058961 | A1 | 3/2018 | Dunham et al. | |

OTHER PUBLICATIONS

Notice of Allowance for U.S. Appl. No. 16/562,028, dated Mar. 23, 2020, 5 pages.

* cited by examiner

PRESSURE ACTIVATED RELEASE CUE FOR ARCHERY

This U.S. Non-Provisional Patent Application is a Continuation of and claims the benefit of priority from U.S. patent application Ser. No. 16/562,028, filed Sep. 5, 2019, the entire disclosure of which is hereby incorporated by reference in its entirety.

FIELD

The present disclosure relates generally to archery devices. More specifically, embodiments of the present disclosure relate to trigger cues and mechanoreceptive features that interact with a user to improve accuracy in shooting. Although various embodiments disclosed herein are well suited for use in archery, the present disclosure is not limited to archery applications.

BACKGROUND

Archery predates recorded history and is believed to have been developed between about 10,000 and 9,000 BC. Since that time, there has been a need and motivation to improve accuracy of projected arrows. One factor that is known to negatively impact accuracy is "target panic." Target panic is generally described as any loss of control during the shooting process, particularly at the point or moment of release of an arrow. Specific common manifestations of target panic include not being able to reach anchor before releasing the arrow, release of the arrow before the desired aim, anxiety during the process of aiming, the aim being locked off of the bullseye, jerking the bow to aim to coincide with release, not being able to let go of the arrow, flinching upon release, a high state of anxiety the closer the archer is to aiming and releasing the arrow, and movements/muscle contractions just prior to release of the arrow.

Shock anticipation is believed to be a primary cause of target panic. Shock anticipation is essentially a subconscious response (e.g. a "flinch") in anticipation of pressure or impact. With shooting activities, the recoil of a firearm and the release of a tensioned bow string are two examples of impacts that can induce this subconscious response. The response often manifests as a flinch or movement prior to the release of a bowstring (for example). Of course, when firing a projectile, even subtle movements can result in significant reductions in accuracy. "Linked bracing" is a term used to describe these human muscle movements that immediate precede or are concurrent with the firing of an arrow (for example).

Various devices have been provided that attempt to overcome target panic and linked bracing by preemptively sending information to a user or archer. U.S. Pat. No. 3,097,624 to Bergquist, which is hereby incorporated by reference in its entirety, discloses a bow pull indicator with a steel member that is operable to emit an audible sound upon a certain amount of deflection on the limb of a bow. Bergquist, however, fails to disclose various novel devices, features, and methods of the present disclosure.

In archery, proper shooting comprises drawing a bow to an anchor point on an archer's face, aiming the bow and releasing an arrow. At first the physical processes of shooting the bow are done very cognitively and very slowly while the archer learns. Over time, the process of myelination of neural pathways and imprinting of motor programs within the brain occurs every time the archer repeats the process. After a large number of cognitive repetitions, the process of shooting an arrow can be reproduced subconsciously. This is generally known and referred to as "muscle memory." A novice archer will take some time to aim and release an arrow. As the archer becomes more intent on just concentrating on aiming, the next step in the efficiency of the human brain is for the release to be completely subconsciously linked to the fact that the archer has aimed. Once the mechanical process of shooting a bow can be performed subconsciously, the archer becomes only focused on aiming. When an archer is solely focused on aiming, the release of the arrow along with the rest of the shot is performed substantially subconsciously. Control over when the arrow is released is then out of the archer's control. For example, when an archer is in the process of drawing a bow, the brain "sees" the aim during this drawing process. The brain links the subconscious release right at this time and the arrow is released at various points before the archer reaches full draw. This common malady is often referred to as "snap shooting." It is a manifestation that involves complete loss of control of the string hand. This problem is rooted in the fact that the conscious mind can only direct one activity at a time. If the conscious mind is totally involved in the aiming process, then the subconscious release of the arrow linked to the aim is expedited. The overall results is the process of aiming an arrow becomes problematic to the subconscious because aiming is subconsciously connected or correlated to an upcoming shock.

The target panic associated with such shock is amplified by other stressors including those experienced by a user during a competitive event, hunting, spectator-induced anxiety, and other influences.

SUMMARY

Accordingly, there has been a long-felt and unmet need to provide a device that improves an archery experience by providing feedback to a user. There further exists a need to provide such devices wherein the structure of the operation of the device does not materially impact the proper shooting technique and form of an archer. There also exists a need to provide such devices that are relatively simple and cost-effective to manufacture, use, install, transport, etc.

As used herein, the term "feedback" refers broadly an action or response that provides information to user. Such actions and responses include very minor or subtle means of conveying information. For example, feedback in the present disclosure is contemplated as including but is not limited a single audible sound and a tactile release or shift sensation perceptive by a human hand.

In various embodiments, a bow-mounted device is provided that is operable to produce an audible cue. Specifically, devices of the present disclosure comprise a release cue member that is operable to deflect and create an audible sound when, for example, tension is applied to a bowstring and an opposing compressive force is applied to the riser of the bow. The release motor program (the brain sends a signal to the flexors to give away tension holding the string and the string is released) is attached to the click, thus reducing or eliminating target panic and associated problems. Devices of the present disclosure replace the mental connection of the release being attached to the aim, and control of the string comes back to a release at a proper place and time. And as the release is a subconscious activity that is queued outside of the shooters brain, the bracing normally linked as a pre-release movement is nonexistent or happens too late (i.e. the arrow is already off of the bow). Methods, devices and systems of the present disclosure allow for release of the arrow to be linked to a source outside of the archer's brain during the process of expansion (increasing pressure on the bow riser) and the subconscious release is achieved and complete control of proper motions for accuracy and precision are maintained.

In various embodiments, mechanoreceptive elements and features as shown and described herein are provided in combination with a traditional archery bow. It will be recognized, however, that the present disclosure is not limited to traditional archery bows, or even to archery. While compound bows comprise various means and release aids to minimize the impacts of target panic, it is contemplated that devices of the present disclosure are provided on a compound bow and various other devices and activities that benefit from a stimulus (e.g. audible sound) that is unexpected and subconsciously links an activity (e.g. release of a bow string) to the stimulus.

Embodiments of the present disclosure provide one or more signals or stimuli to a user's brain (and the associated release motor program in the brain). In preferred embodiments, devices and methods of the present disclosure provide at least one of an auditory and a tactile signal to the brain of a user. In further preferred embodiments, an auditory and tactile signal are simultaneously generated by application of force on a bow grip (preferably from the thumb pad of a user's hand). Although devices and methods of the present disclosure are contemplated that provide only one of an auditory and a tactile signal to a user's brain, at least some embodiments contemplate the provision of both to provide an enhanced signal and benefit of having different neural pathways stimulated at exactly the same moment.

Embodiments of the present disclosure are operable for use with archers of any experience and/or skill level. In various embodiments, the present disclosure provides a pressure-activated release trigger incorporated into a glove. The glove is intended to be worn on a user's bow hand. In some embodiments, a button or deflectable member (which is preferably elastic) is provided within a glove and is located on at least one pressure point of the hand (e.g. the thenar fascia, palmaris brevis, and/or hypothenar fascia).

In one embodiment, an archery bow is provided that comprises a riser, an upper limb and a lower limb. The riser comprises a bow handle operable to receive a hand of an archer. A release cue member is provided on the bow handle and is operable to communicate with a hand of an archer. In preferred embodiments, the release cue member is provided on a user-proximal side of a bow grip (opposite a distal or down-range side of the grip). The release cue member comprises a deformable elastic member and a pliable cover member, and the deformable elastic member produces an audible sound or "click" and/or a tactile sensation upon being deflected in response to a force applied by the hand of the archer. The audible sound and the tactile sensation comprise a conscious and/or subconscious cue to a user that the arrow should be released.

In another embodiment, an archery release cue member is provided that is operable to be provided on a bow handle of an archery bow. The release cue member comprises a deformable elastic member comprising a spring steel and a convex shape, and wherein a center portion of the deformable elastic member is operable to extend away from a bow handle. A cover member extends over at least a portion of the deformable elastic member and is operable to contact a hand of an archer. At least one fastener operable to secure the cover member to the bow handle. The at least one fastener comprises at least one of an adhesive and a mechanical fastener (e.g. a screw or rivet).

In various embodiments, methods of using an archery bow are provided. In one embodiment, a method of using an archery bow is provided that comprises the steps of: providing an archery bow with a release cue member and wherein the release cue member comprises a deformable elastic member comprising a spring steel and a convex shape wherein a center portion of the deformable elastic member is operable to extend away from a bow handle; a cover member extending over at least a portion of the deformable elastic member and operable to contact a hand of an archer; and at least one fastener operable to secure the cover member to the bow handle. An arrow is provided in communication with the archery bow, and the bow string of the archery bow is drawn by applying tension to the bow string with a first hand and applying a force to a handle of the bow with a second hand. A portion of the second hand is provided in communication with the release cue member. Force is increased upon the release cue member until the deformable elastic member deforms to produce an audible sound and/or a tactile shift sensation, and a user releases the arrow in response and subsequent to the audible sound and/or the tactile sensation.

The above-described embodiments, objectives, and configurations are neither complete nor exhaustive. As will be appreciated, other embodiments of the invention are possible using, alone or in combination, one or more of the features set forth above or described in detail below.

The phrases "at least one," "one or more," and "and/or," as used herein, are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" means A alone, B alone, C alone, A and B together, A and C together, B and C together, or A, B, and C together.

The term "a" or "an" entity, as used herein, refers to one or more of that entity. As such, the terms "a" (or "an"), "one or more," and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C. § 112(f). Accordingly, a claim incorporating the term "means" shall cover all structures, materials, or acts set forth herein, and all of the equivalents thereof. Further, the structures, materials, or acts and the equivalents thereof shall include all those described in the summary of the invention, brief description of the drawings, detailed description, abstract, and claims themselves.

BRIEF DESCRIPTION OF THE DRAWINGS

The accompanying drawings, which are incorporated in and constitute a part of the specification, illustrate embodiments of the invention and together with the Summary given above and the Detailed Description of the drawings given below, serve to explain the principles of these embodiments. In certain instances, details that are not necessary for an understanding of the invention or that render other details difficult to perceive may have been omitted. It should be understood, of course, that the invention is not necessarily limited to the particular embodiments illustrated herein. Additionally, it should be understood that the drawings are not necessarily to scale.

Similar components and/or features may have the same reference label. Further, various components of the same type may be distinguished by following the reference label by a letter that distinguishes among the similar components. If only the first reference label is used, the description is applicable to any one of the similar components having the same first reference label irrespective of the second reference label.

DETAILED DESCRIPTION

Embodiments of the present disclosure have significant benefits across a broad spectrum of endeavors. It is the Applicant's intent that this specification be accorded a breadth in keeping with the scope and spirit of the invention being disclosed despite what might appear to be limiting language imposed by the requirements of referring to the specific examples disclosed. To acquaint persons skilled in the pertinent arts most closely related to the present invention, a preferred embodiment that illustrates the best mode now contemplated for putting the invention into practice is described herein by, and with reference to, the annexed drawings that form a part of the specification. The exemplary embodiment is described in detail without attempting to describe all of the various forms and modifications in which the invention might be embodied. As such, the embodiments described herein are illustrative, and as will become apparent to those skilled in the arts, may be modified in numerous ways within the scope and spirit of the invention.

Figure 1:
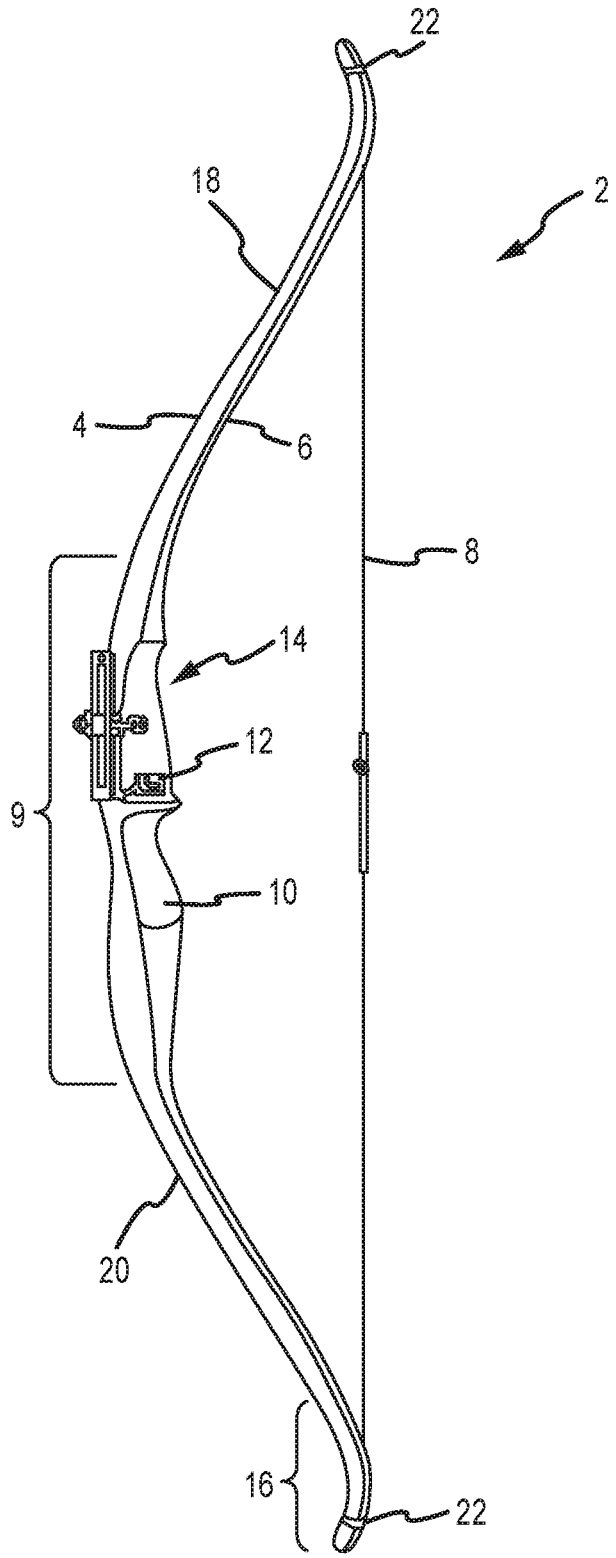
FIG. 1 is an elevation view of a traditional archery bow.

A known archery bow 2 is shown in FIG. 1 for illustrative and descriptive purposes. As shown, the bow 2 comprises a face portion 4 facing a distal or down-range side of the bow, a back portion 6 facing a user-proximal side of the bow, and a bowstring 8 extending between an upper limb 18 and a lower limb 20. The midsection of the bow 2 between the upper limb 18 and the lower limb 20 is commonly known as the riser 9. Included within the riser is a bow grip 10 that is shaped and operable for communication with a user's hand. The riser 9 further comprises an arrow rest 12 and a sight window 14. The upper limb 18 and lower limb 20 are provided with a recurve 16 and a string nock 22. The aforementioned features are commonly provided with traditional archery bows and are used throughout this disclosure. It will be expressly recognized, however, that aspects, embodiments and inventions of the present disclosure are not limited for use with or combination with devices comprising all of these features. Indeed, it is contemplated that feedback and mechanoreceptors of the present disclosure are provided with devices that are not limited to archery, let alone the traditional archery bow shown as an example in FIG. 1.

Figure 2:
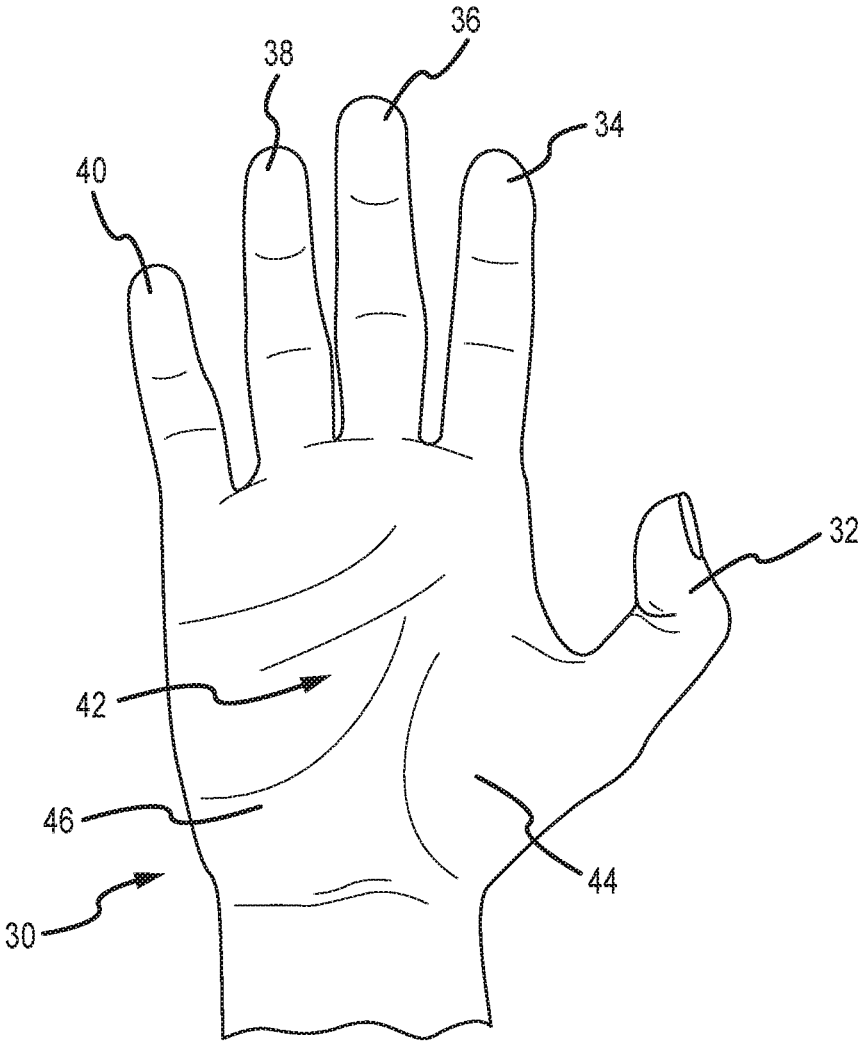
FIG. 2 is an elevation view of a human hand.

FIG. 2 is an elevation view of the human hand 30. As shown, the hand 30 comprises first 32, second 34, third 36, fourth 38 and fifth 40 digits. The palm portion 42 of the hand 30 comprises the thumb pad 44 or thenar fascia. The heel portion 46 of the hand, or the palmaris brevis is shown relative to the thumb pad 44.

Proper archery techniques typically comprise applying a compressive force upon the thumb pad 44 to oppose a tensile force being applied to a bow string with the opposing hand (not shown in FIG. 2). Specifically, pressure is applied to the thumb pad 44 by the bow grip 10 to effect a displacement of the bow riser 9 relative to the bow string 8. As shown and described herein, it is contemplated that devices of the present disclosure are provided on a portion of the bow grip 10 corresponding to the intended location of a user's thumb pad 44. However, the present disclosure and aspects of the invention are not limited to such a specific placement. It is contemplated, for example, that a release cue member may be provided on a portion of the grip 10 corresponding to the heel portion 46, or even on the face side of the bow to communicate with one or more of the digits 32, 34, 36, 38, 40. Additionally, it is contemplated that release cue members in accordance with embodiments of the present disclosure be provided on a single bow. Although preferred embodiments of the present disclosure comprise placing a release cue member corresponding with the thumb pad 44 and alternative arrangements may relate to or encourage improper or inadvisable archery habits, it should be understood that the various embodiments of the present disclosure are not limited to a specific or single orientation of the invention features, components, and methods disclosed herein.

Figure 3:
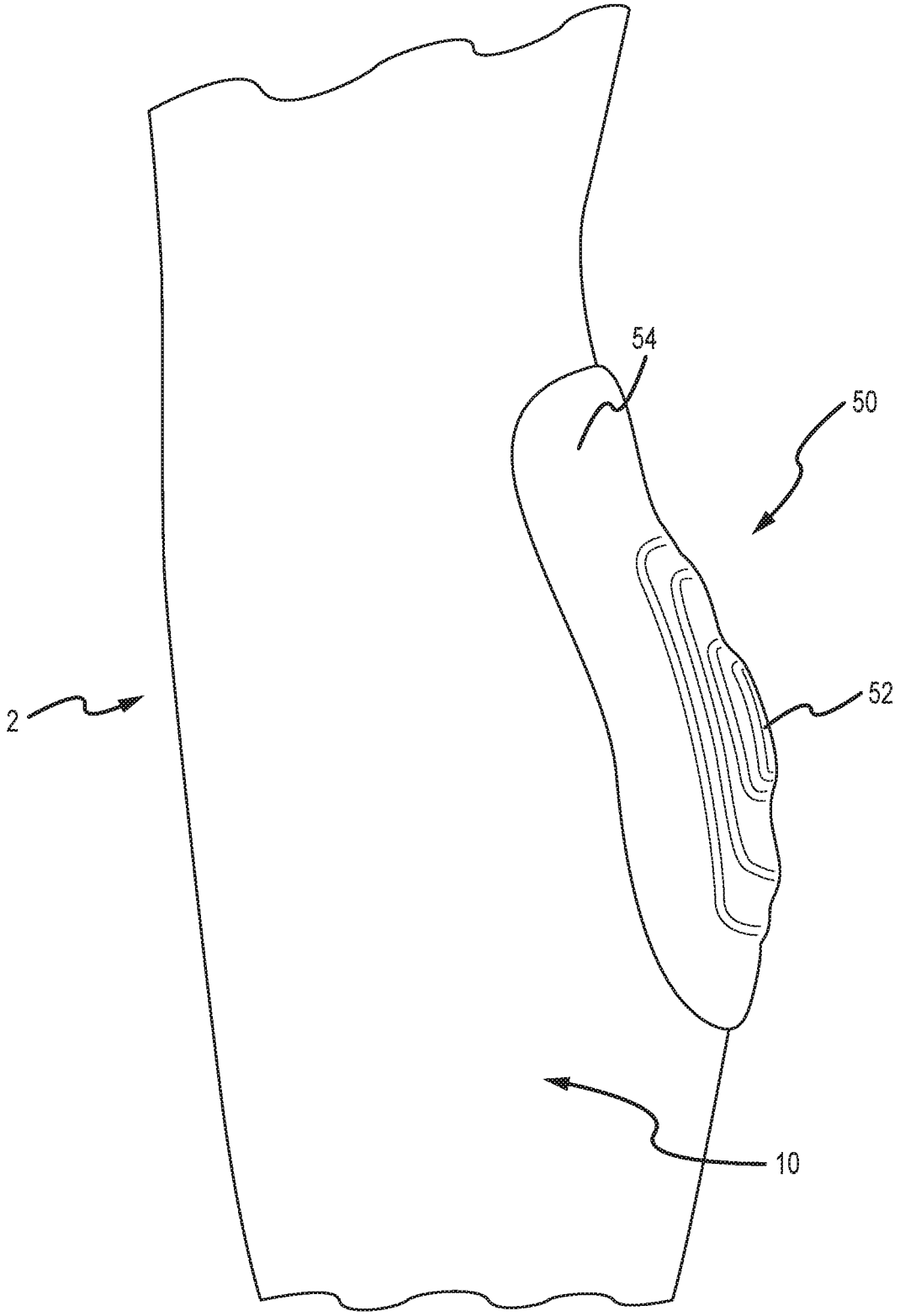
FIG. 3 is an elevation view of a release cue member provided on an archery bow in accordance with one embodiment of the present disclosure.

FIG. 3 is a side elevation view of a release cue member 50 according to one embodiment of the present disclosure provided on a grip 10 of a bow 2. As shown, the release cue member 50 is provided on the bow grip 10 and is provided in a position that corresponds to the intended placement of a user's hand. Preferably, the release cue member 50 is provided in a position that aligns with or corresponds to the intended placement of the thumb pad of the archer's hand. The release cue member 50 of FIG. 3 comprises a sound-emitting device. In some embodiments, the release cue 50 comprises a sound-emitting device in the form a displaceable or deformable member 52. The release cue member 50 of such embodiments comprises an elastic member in the form of a deformable member 52 which, in some embodiments, comprises spring steel that is deflectable, creates an audible sound upon a certain amount of deflection, and comprises an elastic restoring force such that the deformable member 52 is returned to an original position after each use.

In various embodiments, including that shown in FIG. 3, the release cue member 50 comprises a cover member 54. In preferred embodiments, the cover member 54 comprises a rubber member that is operable to secure the elastic member 52 in a certain position on the handle 10. The cover member 54 also provides an ergonomic grip that protects a user's hand from potentially sharp edges or pressure provides by the elastic member 52. Preferably, at least one of the elastic member 52 and the cover member 54 are secured to the bow grip 10. The elastic member 52 and/or the cover member 54 are secured to the bow grip 10 by at least one of an adhesive and a mechanical fastener. Mechanical fasteners of the present disclosure include, but are not limited to screws, rivets, bands, clamps and similar devices.

Figure 4:
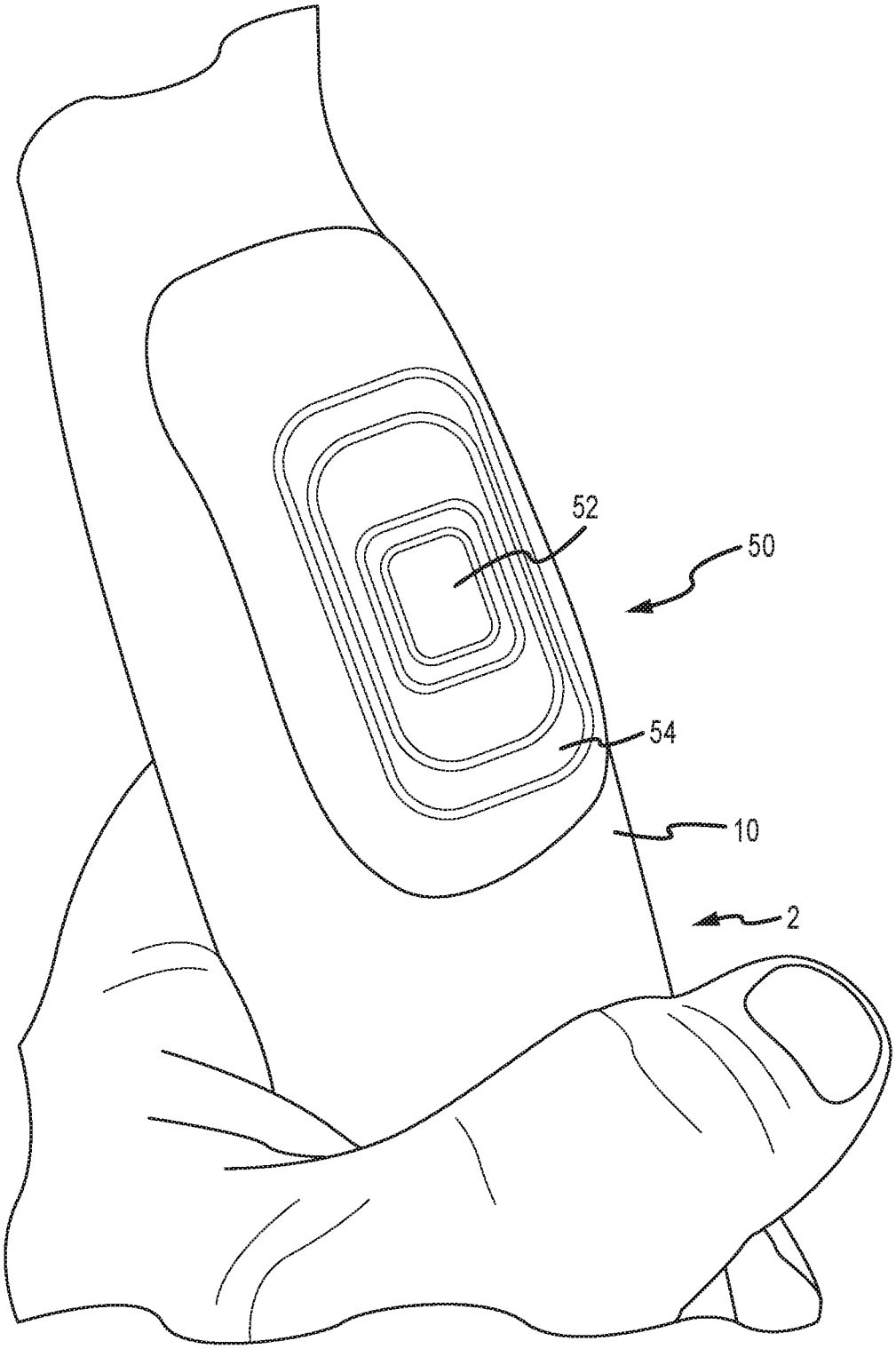
FIG. 4 is a perspective view of the release cue member according to the embodiment of FIG. 3.

FIG. 4 is a perspective view of the release cue member 50 according to the embodiment of FIG. 3. As shown, the release cue member 50 comprises a deformable member 52 that is substantially centered on a lateral midline of the bow grip 10. It will be recognized, however, that in alternative embodiments the release cue member may be provided in various positions on the grip 10. In methods and systems of the present disclosure, the release cue member is positioned and intended to communicate with a thumb pad 44 of an archer's hand. During use, an archer applies pressure to the bow 2 by applying force with one hand and wherein a thumb pad 44 is positioned on the deformable member 52. The user applies pressure or compression to the bow grip while also applying tension to the bow string using the other hand. As will be recognized by one of ordinary skill in the art, the force of pressure on the bow grip 10 and deformable member 52 increases as the string is drawn. A desired amount of tension or "draw" therefore corresponds to a certain downforce on the deformable member 52. The force corresponds to a force upon which the deformable member 52 suddenly and elastically deforms to produce an audible "click" as well as a tactile feedback or sensation upon movement. One or both of these feedback mechanisms communicate to the archer that proper draw has been achieved and the arrow should be released. This feedback and the information conveyed to the archer is at least partially subconscious, particularly after a certain amount of use and familiarity with the release cue 50.

Figure 5:
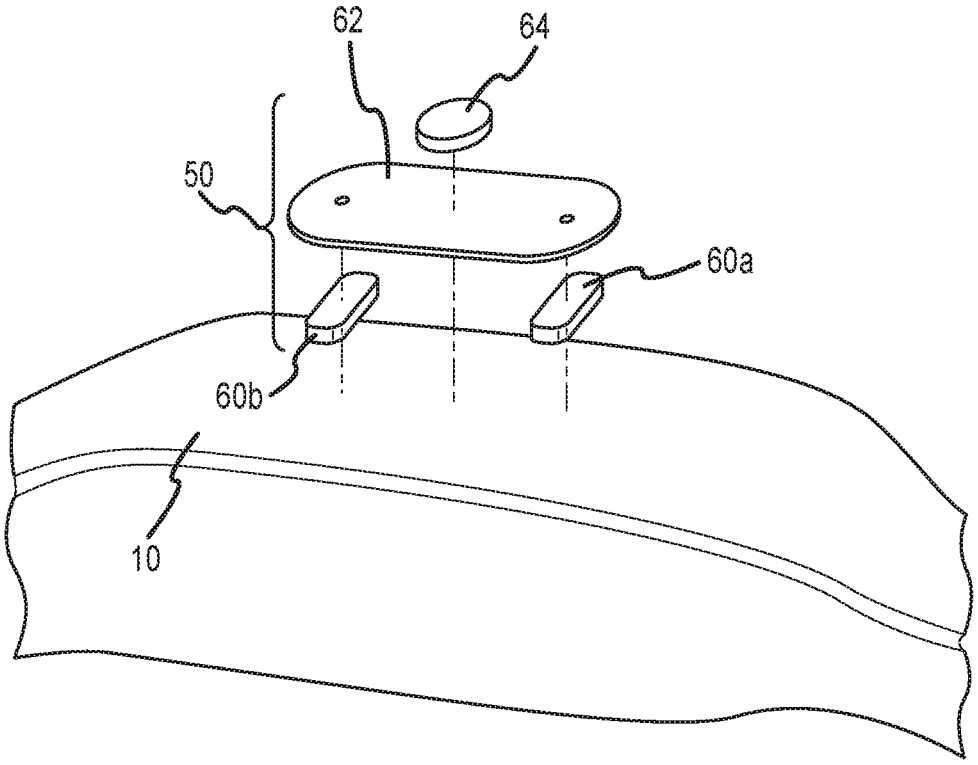
FIG. 5 is an exploded view of a release cue member according to one embodiment of the present disclosure.

FIG. 5 is an exploded view of a release cue 50 according to one embodiment of the present disclosure. As shown, the release cue 50 of the depicted embodiment comprises a plurality of elements. First and second support pads 60*a*, 60*b* are provided on the bow grip 10 and provide support and a stand-off height for the deformable member 62. A pressure pad 64 is provided on a user-proximal side of the deformable member 62. The pressure pad 64 is operable to be used as a pressure concentrator to direct force to the center of the deformable member 62. The deformable member 62 is deflectable in a preferably elastic manner and produces a tactile sensation and an audible click upon reaching a certain critical amount of deflection. Although not shown in FIG. 5, the depicted elements of the release cue 50 are preferably mounted and secured to the bow by a cover member (54 in FIG. 4, for example). The elements 60*a*, 62, 64 are contemplated as being secured to one another and/or the bow grip 10 by various means including but not limited to adhesives.

Figure 6:
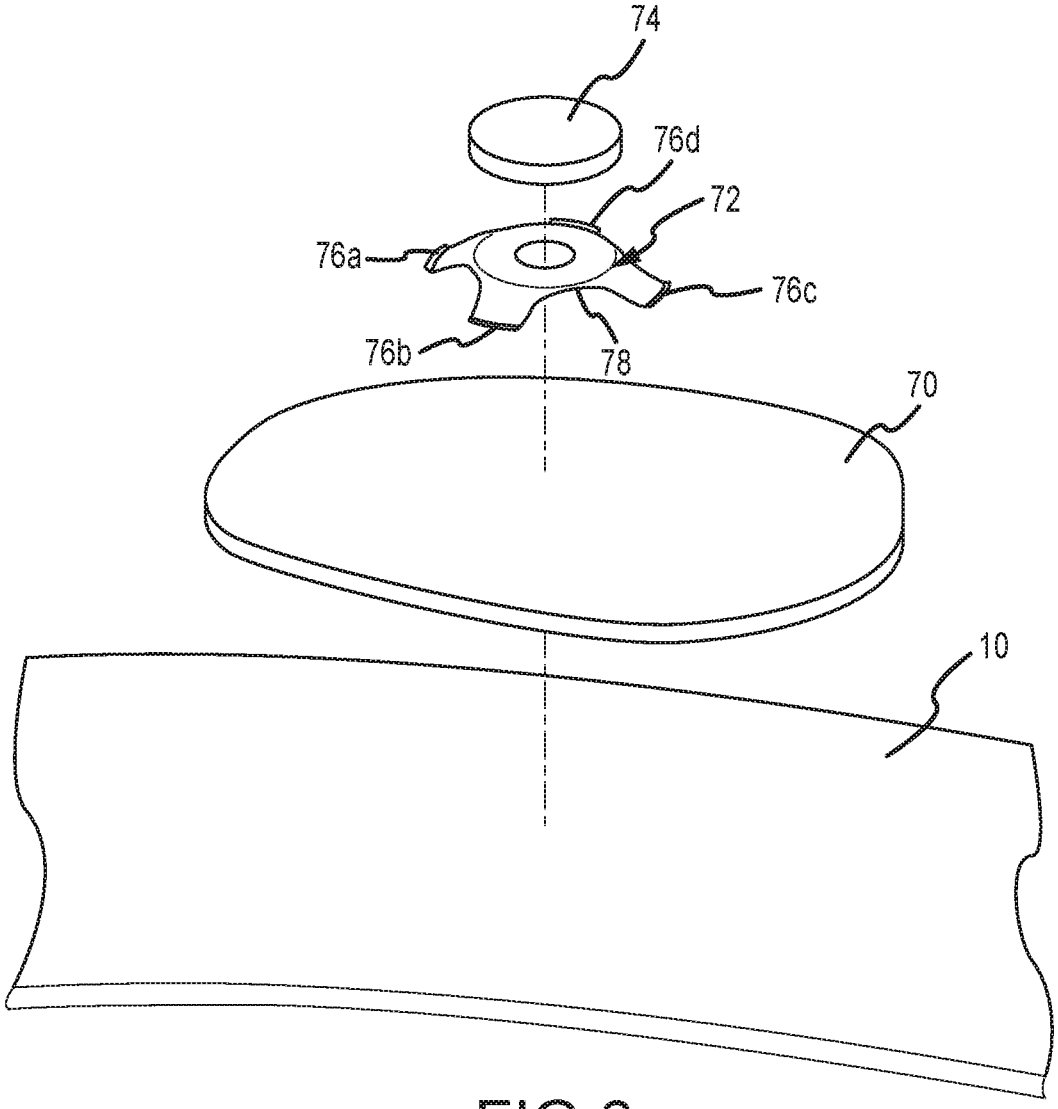
FIG. 6 is an exploded view of a release cue member according to one embodiment of the present disclosure.

FIG. 6 is an exploded perspective view of another embodiment of the present disclosure. As shown, a release cue 50 is provided that comprises a substrate member 70, a deformable member 72, and a pressure pad 74. The substrate or substrate member 70 is contemplated as comprising any one or more of plastic, rubber, silicone rubber, felt, textiles, and combinations thereof. As shown, the deformable member 72 of FIG. 6 comprises a plurality of projections 76*a*, 76*b*, 76*c*, 76*d* extending from a midsection 78. The deformable member 72 comprise a convex structure that can be deformed and/or depressed and produce an audible click as well as a tactile feedback. The substrate 70 is provided between the deformable member 72 and the bow grip 10 to allow the projections 76*a*, 76*b*, 76*c*, 76*d* of the deformable member 72 to slide or translate relative to the bow grip. The substrate 70 allows the deformable member 72 to be secured to a bow and adjusted on the bow without adhering or fastening objects directly to the bow handle. Although not shown in FIG. 6, a cover member is provided over the elements shown in FIG. 6 to secure the elements in place, provide an ergonomic feel, and to protect the elements and an archer's hand.

Figure 7:
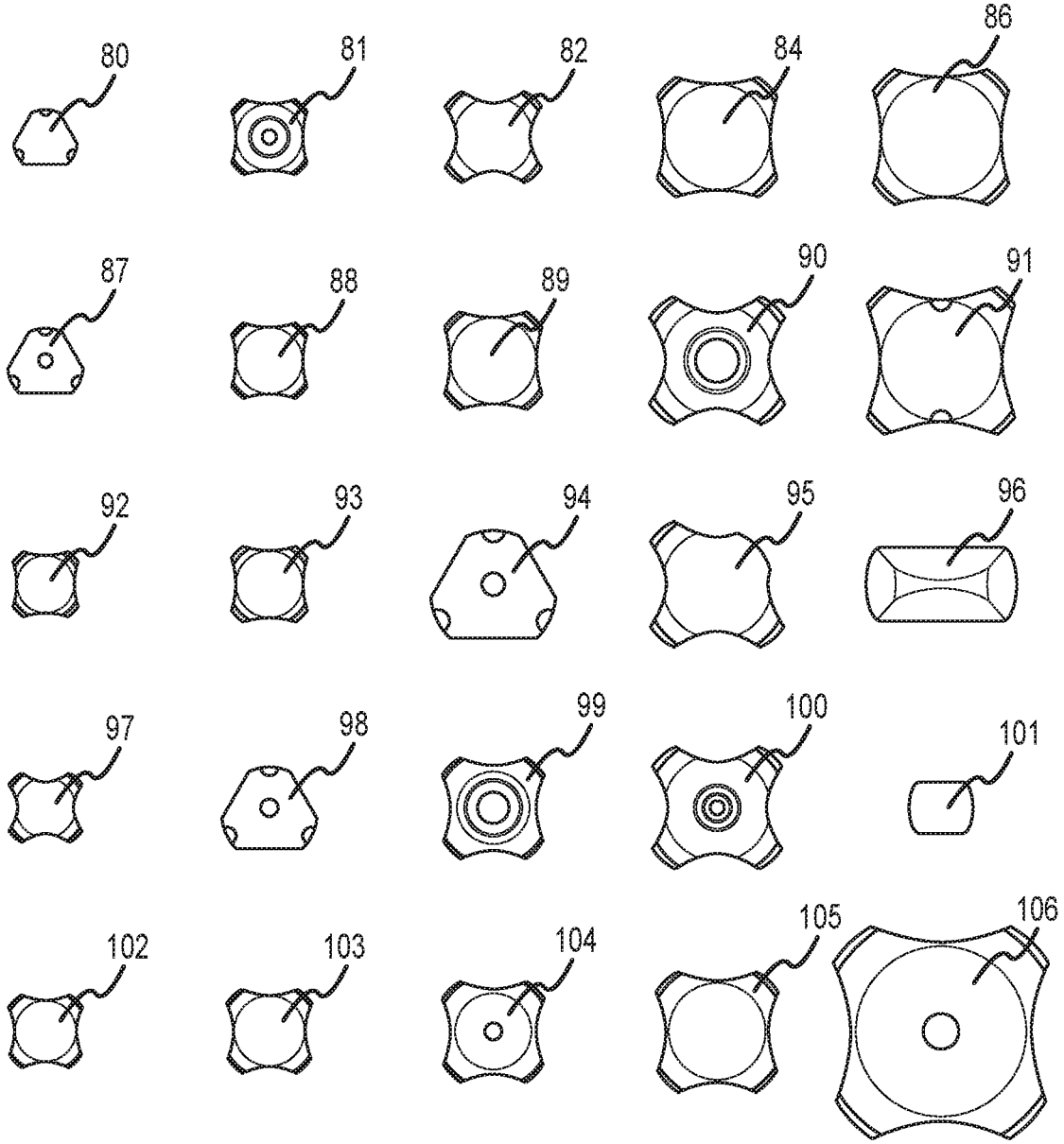
FIG. 7 is a plan view of a plurality of devices contemplated for use with embodiments of the present disclosure.

FIGS. 5-6 depict release cue members comprising deformable members according to certain embodiments of the present disclosure. It should be recognized, however, that the present disclosure and inventions disclosed herein are not limited to any particular shape or structure of deformable member. FIG. 7 provides an array of deformable members 80-106 that are contemplated for use with embodiments of the present disclosure. As shown in FIG. 7, various different deflectable clicker devices are contemplated for use with release cues 50 of the present disclosure. Different members may be employed and substituted based on user preference, desired amount of force required to activate a deformable member, and the size or type of bow grip to which the deformable member is to be applied, for example.

Figure 8:
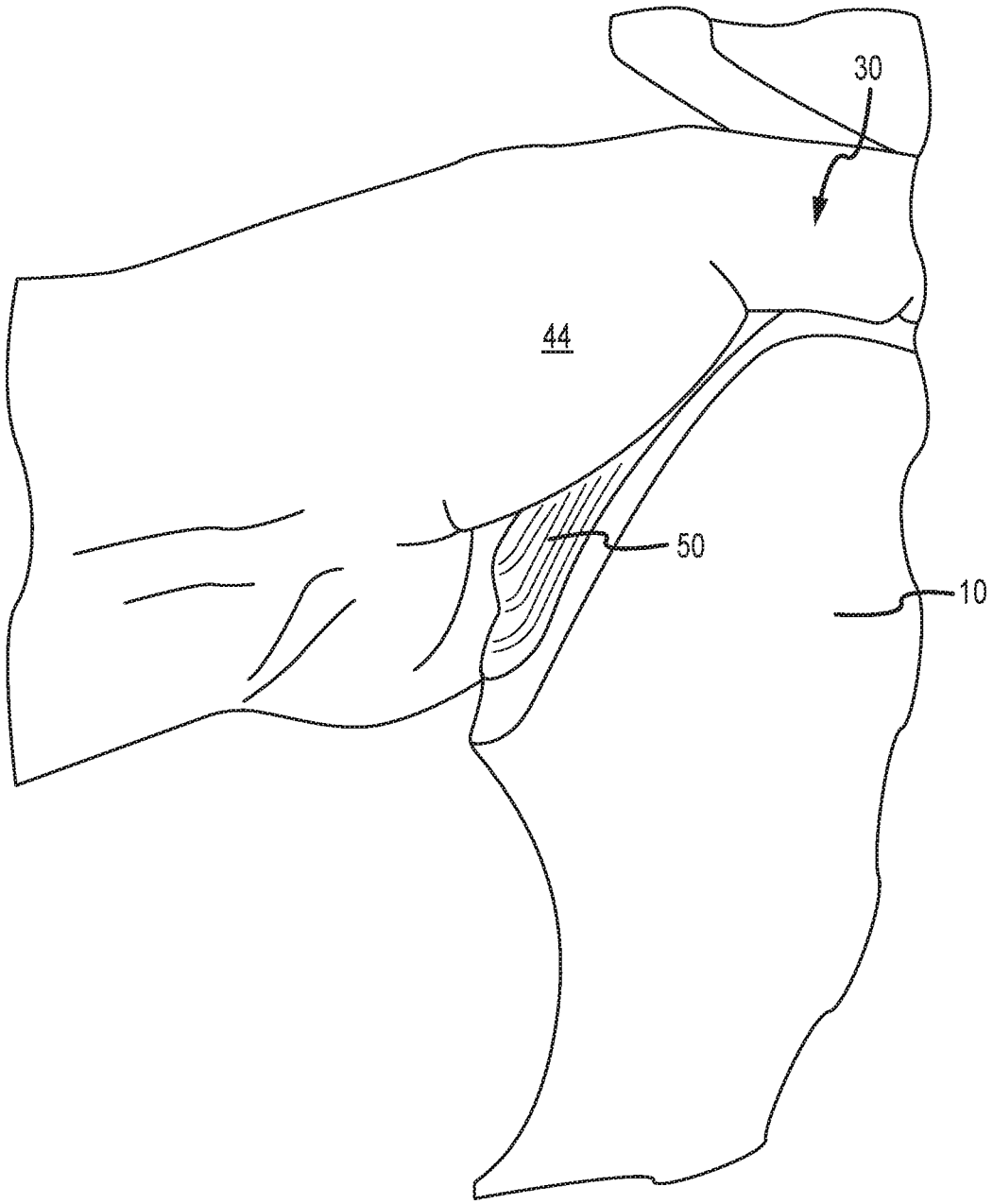
FIG. 8 is an elevation view of an archery bow and a release cue member according to one embodiment of the present disclosure.

FIG. 8 is an elevation view of a bow grip 10 with a release cue 50 according to an embodiment of the present disclosure. An archer's hand 30 is shown for context. As shown, the thumb pad 44 of the archer's hand 30 is provided in contact with the release cue 50. The thumb pad 44 is operable to apply a force to the release cue 50, particularly when an opposite hand (not shown in FIG. 8) applies tension to or draws a bow string associated with the bow. Upon the application of a certain amount of force to the release cue 50 via the thumb pad 44, a deformable member of the release cue is suddenly and elastically deformed. This sudden deformation results in a tactile sensation that is transmitted into the user's hand 10, and produces an audible sound. These release cue members convey information to a user that sufficient draw or tension has been achieved and the arrow should be released. Additionally, the release cue members are activated or accomplished through the normal and preferred motions and technique for shooting. Embodiments of the present disclosure rely on proper technique for activation and do not require additional movements or alter the proper technique of an archer. In fact, preferred embodiments of the present disclosure contemplate a placement of release cue 50 such that proper technique is encouraged and reinforced. Specifically, operation of preferred embodiments of the present disclosure comprises proper application of force from a user's thumb pad and a compression force applied to the correct location on the bow grip is rewarded. If, for example, an archer attempts to employ an improper technique on the bow and apply pressure using the palm or heel portion 46, the release cue member may fail to operate and the user will be drawn to the proper technique of applying force through the thumb pad 44.

Figure 9:
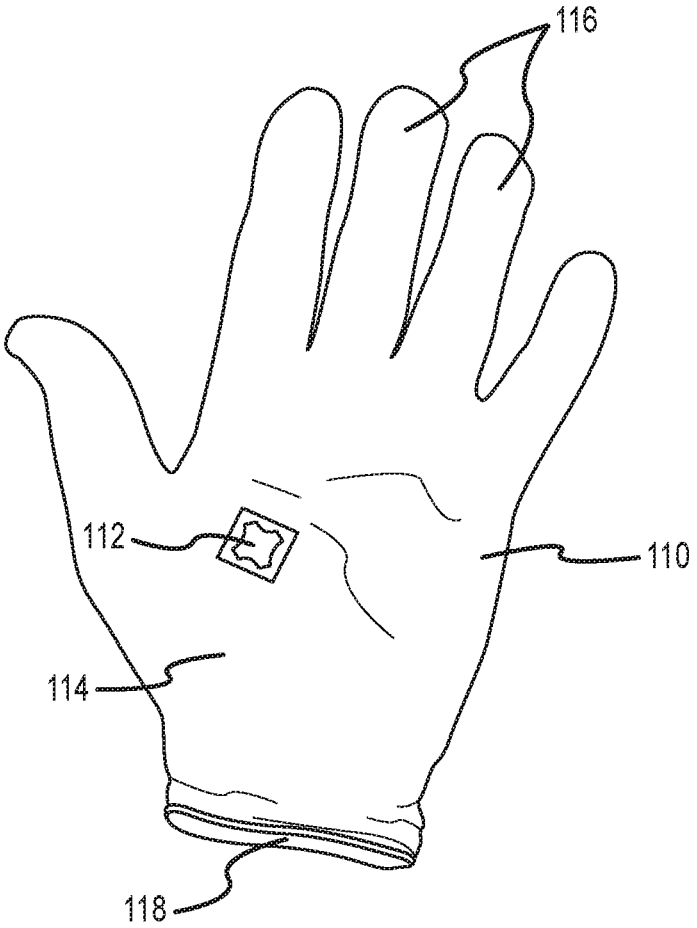
FIG. 9 is a perspective view of a glove with a release cue member according to one embodiment of the present disclosure.

FIG. 9 is an elevation view of a release cue member according to one embodiment of the present disclosure. As shown, the release cue member comprises a glove 110 operable for use with a human hand. The glove 110 comprises various known components and structures of a glove including, for example, a plurality of fingers 116 and an opening 118. The glove 110 of FIG. 9 further comprises a deformable member 112 provided in the thumb pad 114 of the glove 110. The glove 110 of FIG. 9 operates with the same principles as shown and described with respect to bow-mounted devices shown and described herein. However, the deformable member 112 is provided in the glove rather than on the body of a bow. When worn on an archer's bow hand, the deformable member 112 is operable to be depressed and/or compressed to cause a deflection that creates an audible and/or tactile feedback to the archer.

The glove is worn by an archer and is operable for use with various different bows (as the release cue is integrated into the glove and the archer can maintain the benefits of the release cue while shooting different bows). In various embodiments, method of providing a release cue with a deformable member in a glove are provided. In some embodiments, a glove 110 is provided that is customized for an archer. The glove is contemplated as being provided in the appropriate size for the archer's bow hand, and the archer is contemplated as being evaluated to determine the exact positioning of a pressure point on the thumb pad of the user's hand where the release cue and deformable member 112 should be provided.

The release cue is contemplated as being sewn or stitched into the glove. The release cue can be sewn to the interior or exterior of the glove and provided with a covering and/or the release cue can be secured between inner and outer layers of the glove. In some embodiments, the deformable member 112 is secured to a substrate (70 in FIG. 6, for example) and the substrate is stitched or sewn to the glove using known methods. A pressure pad (74 in FIG. 6, for example) is contemplated as being provided on the deformable member of the glove. In some embodiments, the area or region of the glove that comprises the release cue and deformable member is labelled or otherwise indicated. For example, in some embodiments, the glove comprises a first color (e.g. tanned leather) and the region comprising the release cue comprises a second color (e.g. red) or an indicia (e.g. bullseye) to visually indicate the exact position of the feature within the glove. An area directly above or below the release cue is contemplated as being reinforced. For example, a leather glove comprising a release cue may comprise an additional layer of leather or suede over the release cue to accommodate the anticipated forces and stresses on that component. Gloves with release cues of the present disclosure are contemplated as being provided in left and right-handed gloves, as users are expected and known to shoot with either hand.

Although a full-fingered glove is shown in FIG. 9, embodiments of the present disclosure are not so limited. For example, it is contemplated that an archery glove is provided with a release cue as shown and described herein in the thumb pad portion of the glove (or other location) and the glove does not comprise full fingers. Rather, the glove comprises partial fingers that allow a user's fingers to extend therefrom and maintain dexterity at the fingertips, for example. In further embodiments, it is contemplated that a hand-mounted release cue is provided that does not resemble a traditional glove. For example, a wristband or strap member that extends around the thumb pad of an archer's hand and that comprises a release cue is contemplated. Devices similar to wrist-braces and protectors, including those shown and described in U.S. Pat. No. 5,652,955 to Skewis, which is hereby incorporated by reference in its entirety, are contemplated as being provided with release cues of the present disclosure. One of ordinary skill in the art will recognize that the benefits of release cues as shown and described herein can be achieved regardless of the specific structure of the glove or hand-mounted device that supports the release cue.

Figure 10:
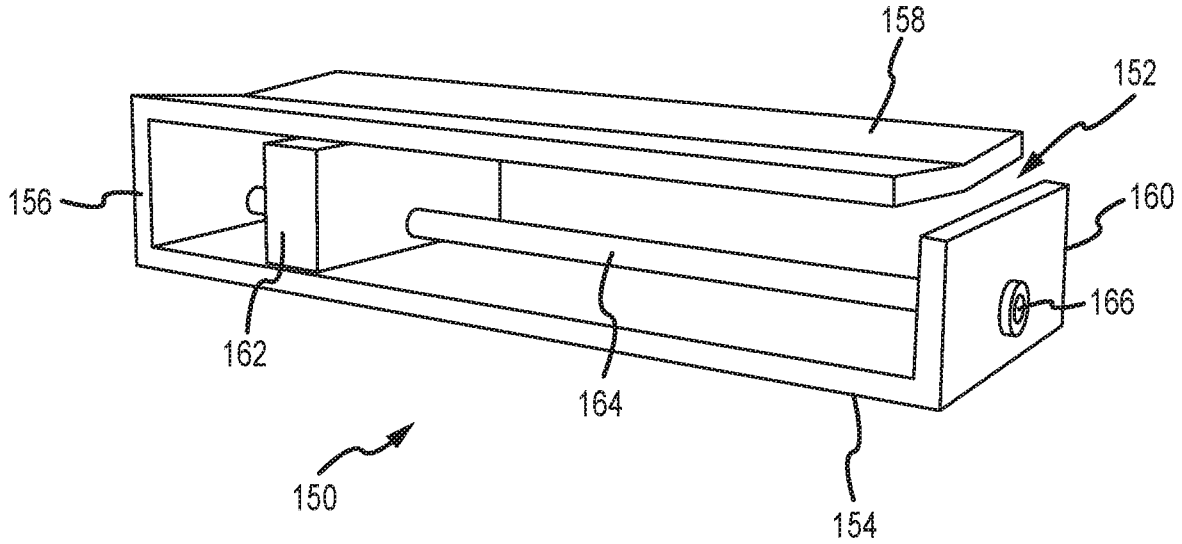
FIG. 10 is a perspective view of an adjustable release cue member according to one embodiment of the present disclosure.
Figure 11:
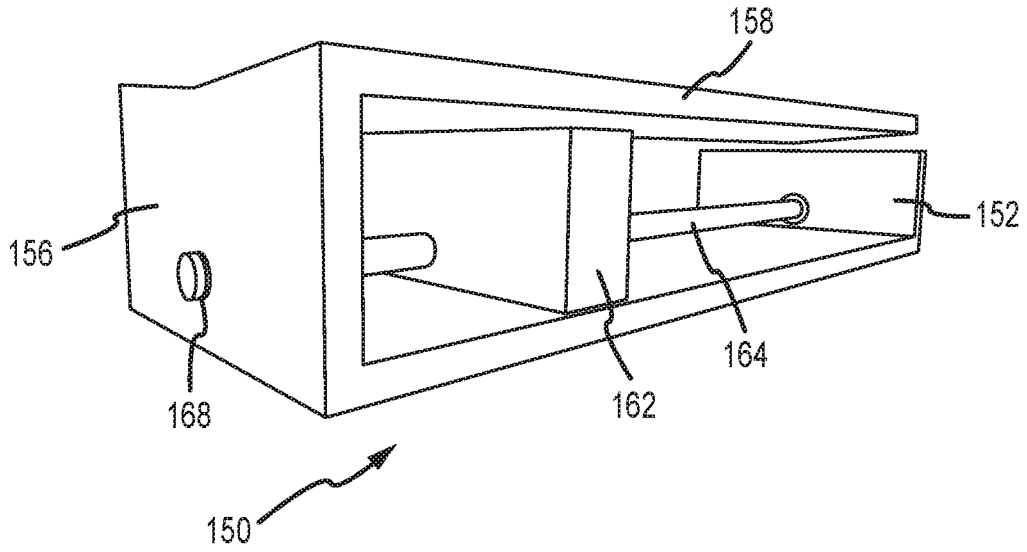
FIG. 11 is a perspective view of an adjustable release cue member according to one embodiment of the present disclosure.
Figure 12:
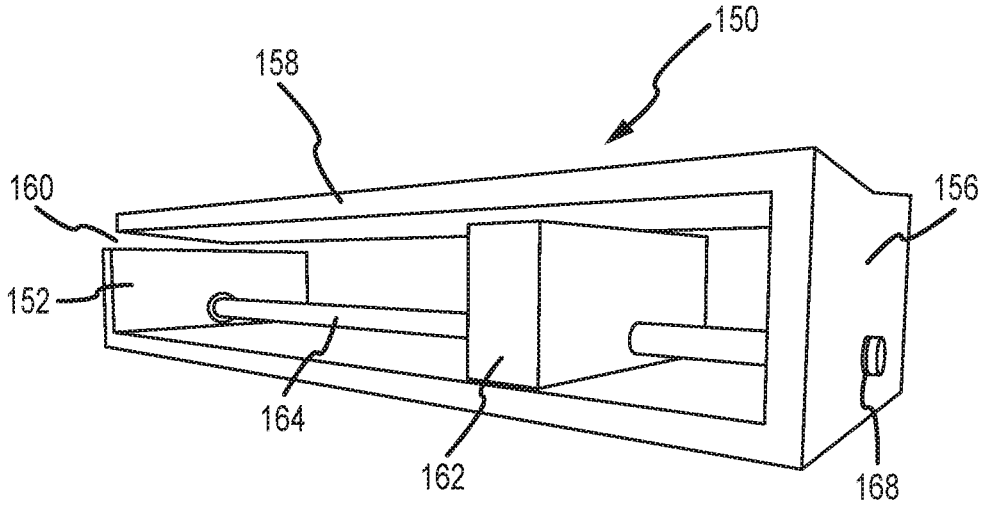
FIG. 12 is a perspective view of an adjustable release cue member according to one embodiment of the present disclosure.

FIGS. 10-12 are perspective views of a release cue 150 according to one embodiment of the present disclosure. The release cue 150 is operable to be provided in combination with and/or mounted on an archery bow but may be employed in various other applications. The release cue 150 comprises a main body having a first end wall 152, a base wall 154, a second end wall 156 and a cantilevered arm 158. In some embodiments, the first end wall 152, the base wall 154, the second end wall 156 and the cantilevered arm 158 comprises a unitary construction and a gap or void 160 is provided between an end of the cantilevered arm 158 and the first end wall 152. The gap 160 allows at least a portion of the cantilevered arm 158 to deflect and move. An adjustable fulcrum 162 is provided. The adjustable fulcrum of the depicted embodiment comprises a translatable block that changes the effective length of the cantilevered arm 158 as it translates. In some embodiments, the adjustable fulcrum is contemplated as comprising a bronze block due to bronze's relatively low coefficient of friction. It will be recognized, however, that the release cue 150 and its various components are not limited to a particular material selection. A threaded rod 164 extends between the first end wall 152 and the second end wall 156 and extends through the adjustable fulcrum 162. Applying torque and rotation to the threaded rod 164 (via a bolt head 166, for example) causes a translation movement of the adjustable fulcrum 162 as the adjustable fulcrum 162 is restrained and prevented from rotating with the rod by contact with at least one of the base wall 154 and the cantilevered arm 158.

The adjustable fulcrum 162 selectively changes the effective length of the cantilevered arm 158. For example, the force required to deflect the cantilevered arm 158 when the adjustable fulcrum 162 is positioned proximal to the second end wall 156 will be less than the force required to deflect the cantilevered arm 158 when the adjustable fulcrum 162 is positioned closer to the first end wall 152. The adjustable fulcrum 162 is operable to change the effective moment arm of the cantilevered arm 158. The release cue mechanism of FIGS. 10-12 comprises a feedback mechanism with adjustable resistance and wherein user's may selectively change or adjust the required amount of force required to activate the mechanism 150.

As shown in FIGS. 10-12, the cantilevered arm 158 comprises a notched or V-shaped cross-section. In order to achieve the appropriate resistance and sudden deformation required to produce audible and tactile feedback, the cantilevered arm 158 is provided with the cross-sectional shape shown in FIGS. 10-12. Other cross-sectional shapes are contemplated including, for example, an inverted V-shape.

The release cue 150 of FIGS. 10-12 may be substituted or used interchangeably with any of the devices shown in FIGS. 7, 5 and 6, for example. It is contemplated that the release cue 150 of FIGS. 10-12 is provided on a bow handle, for example, and further comprises a cover member.

Although the following text sets forth a detailed description of numerous different embodiments, it should be understood that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. To the extent that any term recited in the claims at the end of this patent is referred to in this patent in a manner consistent with a single meaning, that is done for sake of clarity so as to not confuse the reader, and it is not intended that such claim term by limited, by implication or otherwise, to that single meaning.

While various embodiments of the present invention have been described in detail, it is apparent that modifications and alterations of those embodiments will occur to those skilled in the art. Moreover, references made herein to "the present invention" or aspects thereof should be understood to mean certain embodiments of the present invention and should not necessarily be construed as limiting all embodiments to a particular description. It is to be expressly understood that such modifications and alterations are within the scope and spirit of the present invention.

What is claimed is:

1. An archery accessory comprising:

a glove operable for use with a human hand, the glove comprising a plurality of fingers and an opening;

a release cue member provided in a thumb pad of the glove wherein the release cue member is positioned and operable to communicate with a thumbpad portion of a hand of an archer to be depressed or compressed;

the release cue member comprising a deformable elastic member;

wherein the deformable elastic member produces an audible sound and a tactile response upon being deflected in response to a force applied by the thumbpad portion of the hand of the archer.

2. The archery accessory of claim 1, wherein the deformable elastic member comprises spring steel.

3. The archery accessory of claim 1, wherein the deformable elastic member comprises a convex member relative to an interior of the glove.

4. The archery accessory of claim 1, wherein the deformable elastic member is at least one of stitched or sewn into the glove.

5. The archery accessory of claim 4, wherein the deformable elastic member is secured to a substrate and the substrate is secured to the glove.

6. The archery accessory of claim 1, wherein an exterior of the glove comprises a label or indicia corresponding to the location of the release cue member.

7. The archery accessory of claim 1, wherein the force applied comprises a force associated with a desired release point of a drawn arrow.

8. A glove operable for use in archery or shooting, the glove comprising:

a plurality of fingers and an opening;

a release cue member provided in a thumb pad of the glove wherein the release cue member is positioned and operable to communicate with a thumbpad portion of a hand of a user and to be depressed or compressed;

the release cue member comprising a deformable elastic member;

wherein the deformable elastic member produces an audible sound and a tactile response upon being deflected in response to a force applied by the thumbpad portion of a hand of a user.

9. The glove of claim 8, wherein the deformable elastic member comprises spring steel.

10. The glove of claim 8, wherein the deformable elastic member comprises a convex member relative to an interior of the glove.

11. The glove of claim 8, wherein the deformable elastic member is at least one of stitched or sewn into the glove.

12. The glove of claim 11, wherein the deformable elastic member is secured to a substrate and the substrate is secured to the glove.

13. The glove of claim 8, wherein an exterior of the glove comprises a label or indicia corresponding to the location of the release cue member.

14. The glove of claim 8, wherein the force applied comprises a force associated with a desired release point of a drawn arrow.

15. A method of deploying a projectile from an archery bow comprising the steps of:

providing a glove with a release cue member, and wherein the release cue member comprises a deformable elastic member comprising a spring steel wherein a center portion of the deformable elastic member is operable to extend away from a user's hand;

providing an archery bow and a projectile in communication with the archery bow;

grasping the archery bow with the glove such that the release cue member of the glove is in force transmitting communication with the bow;

drawing a bow string of the archery bow by applying tension to the bow string;

wherein force is increased upon the release cue member until the deformable elastic member deforms to produce at least one of tactile and audible feedback; and releasing the projectile in response and subsequent to the audible sound.

16. The method of claim 15, wherein the release cue member is provided in a thumbpad of the glove.

17. The method of claim 15, wherein the release cue member is stitched to the glove.

18. The method of claim 15, further comprising the step of aiming the projectile with the use of a bow sight provided on the archery bow.

19. The method of claim 15, wherein the glove comprises an indicia related to the location of the release cue member within the gloves.

20. The method of claim 15, wherein the force to deform the deformable elastic member comprises a force that corresponds to a desired amount of draw in the bow string.

* * * * *